United States Patent [19]

Namba et al.

[11] Patent Number: 4,635,665

[45] Date of Patent: Jan. 13, 1987

[54] WASHING APPARATUS

[75] Inventors: Yuzaburo Namba, Yatabe; Shigenari Kukisaki, Sayama, both of Japan

[73] Assignee: Eisai Co., Ltd., Tokyo, Japan

[21] Appl. No.: 574,033

[22] Filed: Jan. 26, 1984

[30] Foreign Application Priority Data

Feb. 1, 1983 [JP] Japan ..... 58-13557[U]

[51] Int. Cl.[4] ..... B08B 9/04

[52] U.S. Cl. ..... 134/167 R; 134/171; 134/172; 15/302; 422/63; 422/99; 422/100

[58] Field of Search ..... 134/43, 88, 104, 166 R, 134/166 C, 167 R, 168 R, 169 R, 168 C, 169 C, 171, 172, 152; 15/302, 304; 422/63, 99, 100; 436/49

[56] References Cited

U.S. PATENT DOCUMENTS

| | | | |
|---|---|---|---|
| 2,867,929 | 1/1959 | Monahan | 134/171 X |
| 3,461,478 | 8/1969 | Taylor | 15/302 |
| 3,574,239 | 4/1971 | Sollerund | 15/302 X |
| 3,746,022 | 7/1973 | Fillion et al. | 134/152 X |
| 3,849,830 | 11/1974 | Wagner | 134/171 X |
| 3,916,924 | 11/1975 | McGowan | 134/168 R X |
| 4,053,284 | 10/1977 | Posch | 134/104 X |
| 4,144,901 | 3/1979 | Stevenson | 134/166 R X |
| 4,202,072 | 5/1980 | Gonzales | 15/302 |
| 4,227,886 | 10/1980 | Bullock et al. | 134/152 X |
| 4,310,010 | 1/1982 | Svoboda | 134/92 X |
| 4,341,568 | 7/1982 | Christensen | 15/304 X |

*Primary Examiner*—Harvey C. Hornsby
*Assistant Examiner*—Frankie L. Stinson
*Attorney, Agent, or Firm*—Murray and Whisenhunt

[57] ABSTRACT

This washing apparatus comprises holding a pipe assembly by means of a holding means. Said pipe assembly is consisted of a pouring pipe which acts to pour a wash liquid in micro wells of a container and a suction pipe which acts to suck said waste wash liquid from said micro wells. Said pipe assembly is formed of a dual-pipe consisting of a suction pipe and a pouring pipe disposed inside said suction pipe. The forward end opening portions of said both pipes are located on the substantially same plane.

5 Claims, 17 Drawing Figures

WASHING APPARATUS

FIELD OF THE INVENTION

This invention relates to a washing apparatus, in particular a washing apparatus for use in washing micro wells provided in reaction containers such as micro cups, microtiter plate and the like or containers designed to separately pour samples or reagents used for chemical and immunological analysis.

Referring to this in more detail, when measuring substances by solid phase immunoassay, more concretely Radio Immunoassay or Enzyme Immunoassay, using said microtiter plate, which includes plural test micro wells, in the manner of adsorption-coating antigen or antibody on the inner surface of these wells, the liquid remaining in said micro wells must be removed, and further the inside of each micro well must be washed with water, buffer solution or the like. This invention can be utilized effectively for these purposes. However, it is to be noted that the usage of this invention is not limited thereto alone.

BACKGROUND OF THE INVENTION

The conventional washing apparatuses of this type have been constructed so that the pipe assembly of a pipe to pour the washing liquid in micro wells and a pipe to suck out the remaining liquid from the micro wells is held by means of a holding means. However, the pipe assembly of this type is defective in that since said pipe assembly comprises a pouring pipe and a suction pipe located adjacent to each other and arranged in rows and the pouring pipe and/or suction pipe must be bent in the middle and as is difficult to form and assemble, when such a micro well is of a small diameter (about 6 mm), special attention must be paid so that both pipes should be inserted in the well, and if not the outer end portion of either pipe may be forced out of the well, whereby satisfactory insertion is not attainable, or the washing liquid may fall out of the well. In the conventional apparatus comprising a number of pipe assemblies to wash a number of wells arranged in rows simultaneously as seen especially in the case of the microtiter plate, unless located correctly relative to the holding means, it will not only become more difficult to insert each pipe assembly correctly in each well but also, if inserted, when each pipe assembly is not located uniformly relative to each well, the washing efficiency of each well is different. Accordingly, the conventional apparatus must be said to be defective in that it is not easy to manufacture in order to prevent the occurrence of such disadvantageous and is also inferior in efficiency.

SUMMARY OF THE INVENTION

It is an object of this invention to provide a washing apparatus which is capable of eliminating the above mentioned drawbacks inherent in the conventional washing apparatuses, is simple in construction and easy to manufacture and further is capable of inserting the pipe assembly into each well with ease and accuracy, and is capable of carrying out the washing operation accurately as well as rapidly.

The above object can be achieved by the provision of a washing apparatus according to this invention wherein a pipe assembly is formed of a dual pipe comprising a suction pipe and a pouring pipe disposed inside the suction pipe, and the forward end opening portions of both pipes are located on the substantially same plane.

It is another object of this invention to provide a washing apparatus which is capable of eliminating the drawbacks inherent in the conventional washing apparatus provided with a number of pipe assemblies and holding means for holding these pipe assemblies, is easy to manufacture as compared with the conventional ones, and further is capable of inserting a number of pipe assemblies in their corresponding wells at a time correctly and rapidly.

The above object can be achieved by the provision of a washing apparatus according to this invention wherein a pipe assembly is formed of a dual pipe comprising a suction pipe and a pouring pipe disposed inside the suction pipe, and the forward end opening portions of both pipes are located on the substantially same plane.

According to an example of this invention, the plane, on which the forward end opening portions of both pipes are located, may be a horizontal surface, a slope or a horizontal surface provided with several notches. Each of them is observed to exhibit a similar function.

According to another example of this invention, a holding means for holding a number of pipe assemblies is box-shaped. The inside of this box body is divided into a supply chamber and a suction chamber by a partition plate, wherein an inlet is connected to said supply chamber, an outlet is connected to said suction chamber respectively and further the supply chamber is connected with a detergent supply means and the suction chamber is connected with a residual liquid suction means respectively.

These and other features and advantages of this invention will become apparent upon reading the following specification, which, along with the patent drawings, describes and discloses a preferred illustrative embodiment of the invention in detail.

The detailed description of the specific embodiment makes reference to the accompanying drawings.

DETAILED DESCRIPTION OF THE INVENTION

Figure 1:
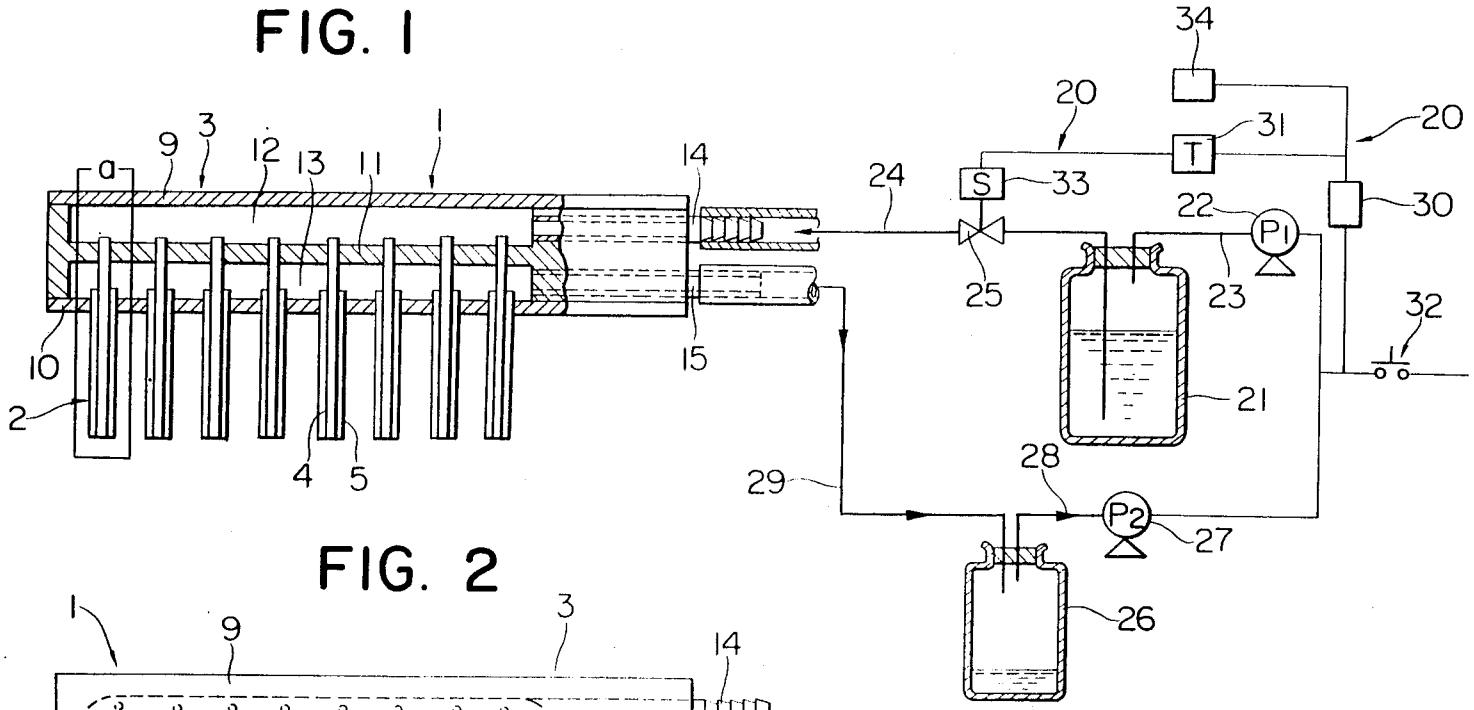
FIG. 1 is a view illustrating the connection of a partly sectional preferred embodiment of the washing apparatus according to the present invention with a diagrammatically shown controlling means.
Figure 2:
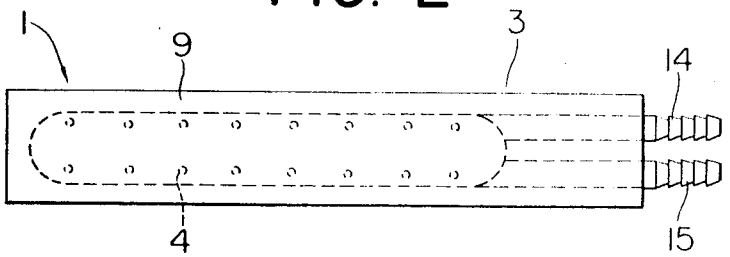
FIG. 2 is a plan view of the holding means shown in FIG. 1.

In FIG. 1, reference numeral 1 denotes a washing apparatus. This washing apparatus 1, as shown best clearly in FIG. 4, includes a pipe assembly 2 and a holding means 3 to which said assembly is attached. It can be seen from FIG. 1 that a number of pipe assemblies 2 are attached to a holding means 3. However, the number of pipe assemblies may be one or more according to the number of containers to be washed.

Figure 4:
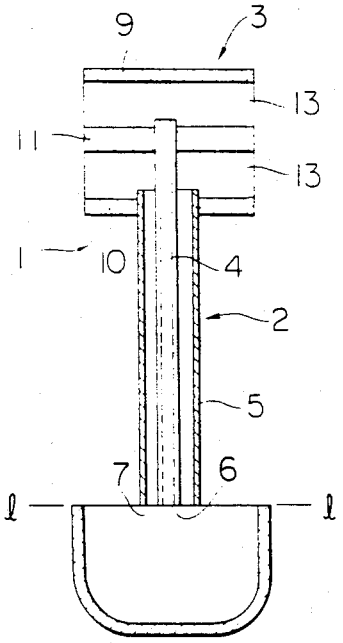
FIG. 4 is a grossly enlarged sectional view clarifying relation between the portion a of FIG. 1 and the wells to be washed.
Figure 5:
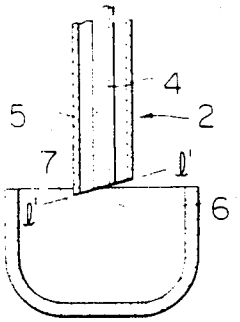
FIG. 5 and FIG. 6 are views similar to FIG. 4 showing modified forms of the pipe assembly of this invention.
Figure 6:
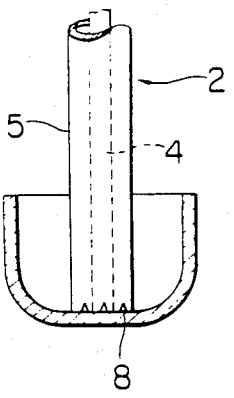

In the pipe assembly 2, a dual pipe is formed by disposing a pouring pipe 4 inside a suction pipe 5, and the forward end opening portions 6, 7 of both pipes are located on the substantially same plane l—l, and its tolerable range was found to be 0– about 0.5 mm (FIG. 4). As mentioned above, this plane may be a horizontal surface, or may be a slope as shown in FIG. 5, and further may be provided with notches 8 as shown in FIG. 6.

The reason why the opening end portions 6, 7 thus must be on the substantially same plane will be referred to afterwards.

The holding means 3 have two chambers, an upper supply chamber 12 and a lower suction chamber 13 by a partition plate 11 disposed between upper and lower plates 9, 10 of this box body. The upper end of the pouring pipe 4 is attached to the partition plate 11 and opens in the supply chamber 12, while the upper end of the suction pipe 5 is attached to the lower plate 10 and opens in the suction chamber 13. And, the side wall of this holding member 3 is provided with an inlet pipe 14 and an outlet pipe 15 which communicate with the supply chamber 12 and the suction chamber 13 respectively.

In FIG. 1, reference numeral 20 denotes a diagrammatically illustrated controlling means, and 21 denotes a wash liquid tank. This tank 21 is connected with a pressure pump 22 through an air supply pipe 23, and further is connected with a liquid supply pipe 24. This pipe 24 is connected at its forward end with the inlet pipe 14, and is provided midway with a valve 25. Reference numeral 26 denotes an exhaust liquid tank. This tank is connected with an air suction pump 27 through an air suction pipe 28, and further is connected with a liquid suction pipe 29 whose forward end is connected with the outlet pipe 15. Both pumps 22, 27 are connected to an electric source (not shown) through a switch 32.

The washing apparatus 1 is designed, like the conventional one of this type, to move vertically by the action of a suitable working mechanism 34.

Reference numeral 30 denotes a controller. This controller 30 is connected with an electric source through a switch 32, and further is connected with a solenoid 33 used for working the valve 25 through the working mechanism 34 and a timer 31.

Moreover, the washing apparatus 1, like the conventional apparatuses of this type, is designed to move vertically by means of a proper working mechanism (not shown). In this embodiment, said working mechanism is operated as referred to afterwards.

Figure 3:
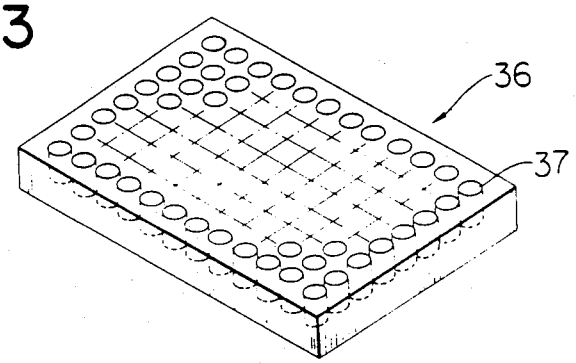
FIG. 3 is a perspective view illustrating one example of the microtiter plate provided with a member of wells to be washed by using the washing apparatus of this invention.

Next, FIG. 3 illustrates one example of a microtiter plate 36 wherein plural wells 37 are washed by means of the aforesaid washing apparatus 1, and this washing operation will be explained with reference to FIG. 7A to FIG. 7E. In this instance, it is supposed for explanatory convenience that the pipe assembly 2 used herein is one in number and accordingly the well 37 to be washed is one in number.

(1) The plate 36 is brought under the washing apparatus 1. The pipe assembly 2 and the well 37 are well located. Thereupon, the switch 32 is on.

Figure 7A:
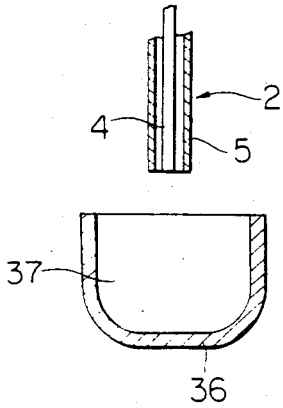
FIG. 7A to FIG. 7E are the sectional views of pipe assemblies and containers showing the order of operation for washing containers by using the apparatus illustrated in FIG. 1.

(2) Due to this, pumps 22, 27 are operated. However, as the controller 30 does not order to work the working mechanism, the working mechanism 34 does not work so that the washing apparatus 1 is retained at its original position, and the valve 25 is also not work and kept closed at this stage (FIG. 7A).

No wash liquid is poured from the pouring pipe 4, and at this time the pump 22 is controlled to feed air to the tank 21 by the action of a pressure switch or the like.

Figure 7B:
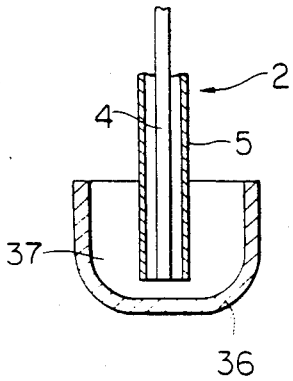

(3) Then, the controller 30 orders the working mechanism to work, whereby the washing apparatus 1 descends to enter the pipe assembly 2 into the well 37, and stops when the pipe assembly reaches near the bottom of the well (FIG. 7B). Upon said descending, the pump 27 works so as to suck the waste liquid within the well 37 through the suction pipe 5 and discharge it in the exhaust liquid tank 26.

Figure 7C:
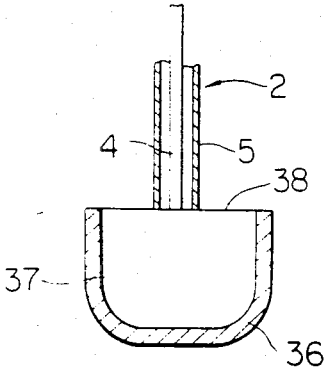

(4) Thereafter, the controller 30 orders the working mechanism 34 to operate for ascending the washing apparatus 1 until the forward end opening portions 6, 7 of the pipe assembly 2 reaches the position substantially corresponding to the opening portion 38 of the plate 36, and stops the washing apparatus 1 there (FIG. 7C). Thereafter, the timer 31 operates to open the valve 25 by the action of the solenoid 33 so that while a fresh wash liquid is poured into the well 37 through the pouring pipe 4, the waste wash liquid is sucked through the suction pipe 5, whereby the wash liquid flows in whirls to wash the well 37 and after the well 37 has been washed, is discharged in the exhaust liquid tank 26 without flowing over the plate 36. The washing operation is carried out only during the time set by the timer 31. Thereafter, the valve 25 is closed this time by the action of the timer 31, whereby pouring of the wash liquid is stopped.

Figure 7D:
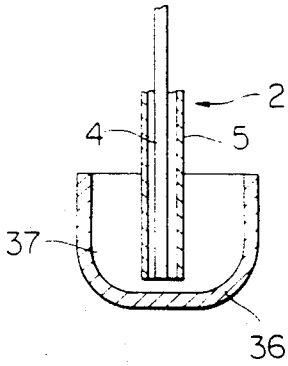

(5) By the said operation of the timer 31, the working mechanism is again worked to descend the washing apparatus 1, while the pipe assembly 2 repeats the exactly same action as described in the preceding (3) and upon reaching the same position, is stopped there. (FIG. 7D).

Figure 7E:
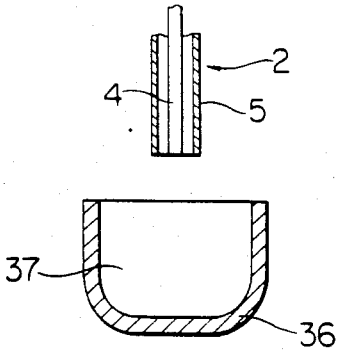

(6) After the pipe assembly 2 has sucked and discharged the exhaust liquid only for a fixed time, the washing apparatus 1 is ascended by the order of the controller 30 and is stopped where it restores its original position. (FIG. 7E). In the above instance, pumps 22, 27 and the controller 30 may be controlled separately by different switches.

Through the above mentioned cycle, the washing work is completed.

The above mentioned washing work has been described to be done automatically by the aid of the controlling means 20. However, for instance in case where a small number of wells are washed, the washing work may be done manually in the same manner as mentioned above.

Figure 8:
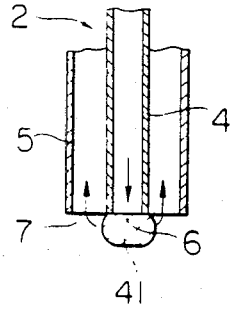
FIG. 8 is an explanatory sectional view illustrating the state of sucking the drop remaining at the forward end of a pouring pipe by a suction pipe in the pipe assembly of the washing apparatus according to this invention.

In process of using the apparatus as mentioned above, since the opening end portions 6, 7 of the pouring pipe 4 and the suction pipe 5 are on the substantially same plane, a remain liquid drop 41 formed at the opening end portion 6 of the pouring pipe 4 as shown in FIG. 8 is sucked at once by the suction pipe 5 adjacent to the pouring pipe 4 and so there is no possibility of dropping directly from the end portion of the pouring pipe.

Figure 9:
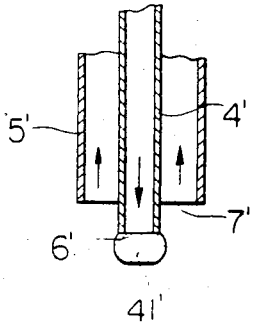
FIG. 9 and FIG. 10 are sectional views explaining the state of operation of pipe assemblies that are different in construction from the pipe assembly according to this invention.
Figure 10:
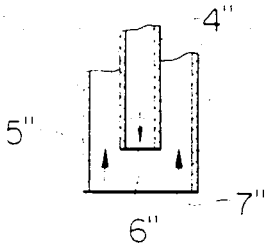
Figure 11A:
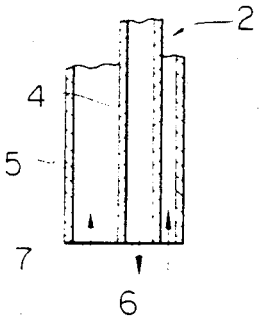
FIG. 11A and FIG. 11B are views explaining the operations of pipe assemblies wherein the relative positions of pouring pipes to suction pipes are different.
Figure 11B:
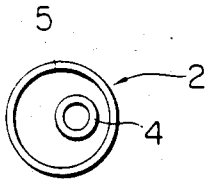

In contrast, in case the opening end portion 6' of the pouring pipe 4' projects downwards over the opening end portion 7' of the suction pipe 5' as shown in FIG. 9, the suction pipe 5' can not suck the liquid 41', while in case the opening end portion 6'' of the pouring pipe 4'' retreats upwards more than the opening end portion 7'' of the suction pipe 5'' inversely and when the pouring pipe 4'' is eccentric as shown in FIG. 11B, there are caused defects that the wash liquid touches the pouring pipe 5 to thereby curve the direction of water flow, its strength is unbalanced and in the worst case it is sucked up before it is used for washing.

Figure 12:
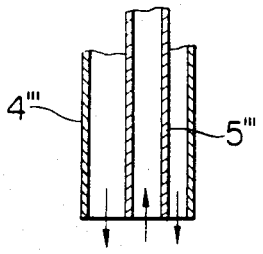
FIG. 12 is a view explaining the operation of a pipe assembly wherein arrangement of a pouring pipe and a suction pipe is reversed in the inside and outside against that of this invention.

In the above embodiment, both pipes 4, 5 are arranged coaxially, but may be arranged eccentrically as shown in FIG. 11A and FIG. 11B. As it is rather difficult to assemble both pipes non-eccentrically, the assembling restrictions are removed and thus the highly efficient pipe assemblies can be produced with ease. In contrast when the inside and outside positions of both pipes 4''', 5''' are inversed as shown in FIG. 12, it brings about an undesirable result that the wash liquid is not poured uniformly from the pouring pipe 4''' due to the unbalanced suction force of the suction pipe 5''', whereby it becomes difficult to carry out the washing operation satisfactorily. Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a micro well washing apparatus including at least one pipe assembly having a pouring pipe for pouring a wash liquid into micro wells, a suction pipe for sucking away waste wash liquid from within said micro wells and a holding means for holding at least one pipe assembly, the improvement comprising providing at least one dual-pipe assembly with a pouring pipe disposed inside of a suction pipe and the forward end opening portions of both pipes being in substantially the same plane, said dual pipe assembly being configured such that at least the forward opening portions of both pipes are disposable within a micro well, movement means for controlled vertical movement of said pipe assembly so that said forward opening portions of both pipes are disposable at both the opening of the micro well and near the bottom thereof, and means for simultaneously supplying wash liquid to said pouring pipe and suction to said suction pipe, whereby wash liquid is poured into and sucked from said micro well at positions of the forward opeining portions of both pipes which include the position of the opening of the micro well and the position of near the bottom of the micro well.

2. A washing apparatus according to claim 1 wherein said plane is a horizontal surface.

3. A washing apparatus according to claim 2 wherein said horizontal surface is provided with several notches.

4. A washing apparatus according to claim 1 wherein said plane is a slope.

5. A washing apparatus according to claim 1 having a plurality of pipe assemblies and wherein said holding means is in the form of a box body, the inside of said box body is divided by a partition plate into a pouring chamber and a suction chamber, said pouring chamber being connected to the inlet of the pouring pipe, said suction chamber being connected to the outlet of the suction pipe, the pouring chamber is connected with a detergent supply means and the suction chamber is connected with a waste liquid suction means.

* * * * *